US009922616B2

(12) United States Patent
Yang et al.

(10) Patent No.: US 9,922,616 B2
(45) Date of Patent: Mar. 20, 2018

(54) DISPLAY CONTROLLER FOR ENHANCING VISIBILITY AND REDUCING POWER CONSUMPTION AND DISPLAY SYSTEM INCLUDING THE SAME

(71) Applicant: SAMSUNG ELECTRONICS CO., LTD., Suwon-si, Gyeonggi-do (KR)

(72) Inventors: Jae Ho Yang, Cheonan-si (KR); Miaofeng Wang, Suwon-si (KR); Ho Seok Shin, Hwaseong-si (KR)

(73) Assignee: SAMSUNG ELECTRONICS CO., LTD., Suwon-si, Gyeonggi-Do (KR)

( * ) Notice: Subject to any disclaimer, the term of this patent is extended or adjusted under 35 U.S.C. 154(b) by 306 days.

(21) Appl. No.: 14/796,808

(22) Filed: Jul. 10, 2015

(65) Prior Publication Data

US 2016/0163248 A1 Jun. 9, 2016

Related U.S. Application Data

(60) Provisional application No. 62/023,408, filed on Jul. 11, 2014.

(30) Foreign Application Priority Data

Nov. 12, 2014 (KR) ..... 10-2014-0157306

(51) Int. Cl.
*G09G 5/10* (2006.01)
*G09G 5/00* (2006.01)

(52) U.S. Cl.
CPC ..... *G09G 5/003* (2013.01); *G09G 2320/066* (2013.01); *G09G 2330/021* (2013.01); *G09G 2360/144* (2013.01)

(58) Field of Classification Search
CPC ..... G06T 5/001; G06T 5/00; G09G 2320/06; G09G 2330/0216
USPC ..... 345/20, 581, 596, 690; 382/162, 274
See application file for complete search history.

(56) References Cited

U.S. PATENT DOCUMENTS

| | | | | |
|---|---|---|---|---|
| 7,302,110 | B2 | 11/2007 | Chesnokov | |
| 8,363,131 | B2 | 1/2013 | Lin | |
| 8,411,987 | B2 * | 4/2013 | Han | G06T 5/20 345/20 |
| 8,442,340 | B2 | 5/2013 | Bertens et al. | |
| 8,593,480 | B1 | 11/2013 | Ballestad et al. | |
| 8,731,322 | B2 | 5/2014 | Lee | |
| 2006/0164524 | A1 * | 7/2006 | Shibano | G06T 5/009 348/234 |
| 2013/0038626 | A1 | 2/2013 | Feda | |
| 2013/0091430 | A1 | 4/2013 | Zhai et al. | |
| 2013/0293121 | A1 | 11/2013 | Viacheslav | |
| 2013/0322753 | A1 | 12/2013 | Lim et al. | |

(Continued)

FOREIGN PATENT DOCUMENTS

KR 1020140023767 2/2014

*Primary Examiner* — Calvin C Ma
(74) *Attorney, Agent, or Firm* — F. Chau & Associates, LLC

(57) ABSTRACT

A display controller includes a local contrast enhancement circuit that includes a plurality of scale circuits. Each scale circuit includes a block separation circuit configured to divide input display data into sub blocks, a calculation circuit configured to calculate a feature value that characterizes each of the sub blocks, and a storage device configured to store the feature value. The number and size of the sub blocks differ among the scale circuits.

20 Claims, 11 Drawing Sheets

(56) References Cited

U.S. PATENT DOCUMENTS

| | | | |
|---|---|---|---|
| 2013/0336596 | A1 | 12/2013 | Toyoda et al. |
| 2014/0169669 | A1 | 6/2014 | Yeh et al. |

* cited by examiner

DISPLAY CONTROLLER FOR ENHANCING VISIBILITY AND REDUCING POWER CONSUMPTION AND DISPLAY SYSTEM INCLUDING THE SAME

CROSS-REFERENCE TO RELATED APPLICATIONS

This application claims priority under 35 U.S.C. § 119(e) from U.S. provisional patent application No. 62/023,408 filed on Jul. 11, 2014 in the U.S. Patent and Trademark Office, and under 35 U.S.C. § 119(a) from Korean Patent Application No. 10-2014-0157306 filed on Nov. 12, 2014 in the Korean Intellectual Property Office, and all the benefits accruing therefrom, the contents of each of which are herein incorporated by reference in their entireties.

BACKGROUND

1. Technical Field

Embodiments of the inventive concept are directed to a device for controlling a display device, and more particularly, to a display controller that can enhance the visibility of a display device and reduce power consumption of the display device according to ambient light and a display system including the same.

2. Discussion of the Related Art

Visibility is how discernible something is to the human eye. Tone mapping is a technique used in image processing and computer graphics to map one set of colors to another to approximate the appearance of high dynamic range images in a medium having a more limited dynamic range.

Tone mapping methods may be divided into two types: global tone mapping in which tone mapping is performed on an entire image using only one tone mapping operator; and local tone mapping in which tone mapping is performed on each pixel in an image using the pixel value of each pixel and pixel values of surrounding pixels. However, in global tone mapping, the quality of a tone mapped image decreases when the dynamic range of the image is very large, and local tone mapping may not be suitable for real-time processing because of the amount of computation needed.

SUMMARY

Exemplary embodiments of the inventive concept may provide a display controller that can enhance visibility and reduce power consumption according to ambient light and a display system including the same.

According to some embodiments of the inventive concept, there is provided a display controller, including a local contrast enhancement circuit that includes a plurality of scale circuits. Each scale circuit includes a block separation circuit configured to divide input display data into sub blocks, a calculation circuit configured to calculate a feature value that characterizes each of the sub blocks, and a storage device configured to store the feature value. The number and size of the sub blocks differ from each other. The feature value may be an average value, a median value, a minimum value, or a maximum value.

Each scale circuit may further include an interpolation circuit connected to the storage device and configured to interpolate feature values of sub blocks that surround a current pixel and to generate a luminance value of the current pixel, and a weighted multiplication circuit configured to generate a weighted luminance value using a weight value and the luminance value of the current pixel, and the interpolation circuit may use distance information between the current pixel and each of the surrounding sub blocks while interpolating feature values.

The interpolation circuit may generate the luminance value of the pixel by bi-linearly interpolating the feature values of the sub blocks that surround the current pixel.

The local contrast enhancement circuit may further include an adder circuit configured to sum weighted luminance values generated by the respective scale circuits to generate a final luminance value, and a local tone tuning calculation circuit configured to generate a local tone tuning signal using the input display data, the final exponent, and the final luminance value.

The local tone tuning calculation circuit may generate the local tone tuning signal from $EL=\beta\cdot|EG-1|\cdot(\gamma\cdot L-I_i)$, $I_L=I_i^{EL}$, where $\beta$ is a first user configuration parameter that controls a strength of the local tone tuning signal, EG is the final exponent, $\gamma$ is a second user configuration parameter that controls a direction of the local tone tuning signal, L is the final luminance value, $I_i$ is the input display data, $I_L$ is the local tone tuning signal, and EL is an exponent for the local tone tuning signal.

According to other embodiments of the inventive concept, there is provided a display controller that includes an analyzer configured to generate a first parameter value, a second parameter value, and a luminance control signal based on an ambient light signal, input display data, and power saving attempt level; a global tone mapping circuit configured to generate a final exponent using the input display data, the first parameter value, the second parameter value, and a plurality of user configuration values and to generate intermediate display data using the final exponent and the input display data; a local contrast enhancement circuit configured to generate a local tone tuning signal using the input display data, a plurality of weight values, and the final exponent; and a merger configured to generate output display data using the intermediate display data and the local tone tuning signal.

When one or more of the ambient light signal, the power saving attempt level, and a dark region in the input display data increases, the analyzer may adjust the first parameter value to control a dark tone in the input display data and may adjust the second parameter value to control a bright tone in the input display data.

The analyzer may increase the luminance control signal when the ambient light signal increases and may decrease the luminance control signal when the power saving attempt level increases or the dark region in the input display data increases.

The global tone mapping circuit may generate a first exponent using the first parameter value and a first configuration value from the plurality of user configuration values and may generate first output data using the input display data and the first exponent. The global tone mapping circuit may generate a second exponent using the second parameter value and a second configuration value from the plurality of user configuration values and may generate second output data using the input display data and the second exponent. The global tone mapping circuit may generate the final exponent using a third configuration value from the plurality of user configuration values, the input display data, the first exponent, and the second exponent and may generate the intermediate display data using the input display data and the final exponent.

The first output data may be generated from $$EA = \frac{\log(T_A)}{\log(P_A)},\ I_A = I_i^{EA},$$

where $T_A$ is the first parameter value, $P_A$ is the first configuration value, EA is the first exponent, $I_A$ is the first output data, and $I_i$ is the input display data; the second output data may be generated from $$EB = \frac{\log(T_B)}{\log(P_B)},\ I_B = I_i^{EB},$$

where $T_B$ is the second parameter value, $P_B$ is the second configuration value, $I_B$ is the second output data, and EB is the second exponent; and the intermediate display data may be generated from $EG=(1-I_i^{\alpha})\cdot EA+I_i^{\alpha}\cdot EB$, $I_G=I_i^{EG}$, where $\alpha$ is the third configuration value, $I_G$ is the intermediate display data, and EG is the final exponent.

The local contrast enhancement circuit may include a plurality of scale circuits. Each scale circuit may include a block separation circuit configured to divide input display data into sub blocks, a calculation circuit configured to calculate a feature value that characterizes each of the sub blocks, and a storage device configured to store the feature value. The number and size of the sub blocks may differ from each other.

Each scale circuit may further include an interpolation circuit connected to the storage device to interpolate feature values of sub blocks that surround a current pixel and to generate a luminance value of the current pixel, and a weighted multiplication circuit configured to generate a weighted luminance value using the luminance value and a corresponding weight value. The interpolation circuit may use distance information between the current pixel and each of the surrounding sub blocks while interpolating feature values.

The local contrast enhancement circuit may further include an adder circuit configured to sum weighted luminance values generated by the respective scale circuits to generate a final luminance value; and a local tone tuning calculation circuit configured to generate the local tone tuning signal using the input display data, the final exponent, and the final luminance value.

The local tone tuning calculation circuit may generate the local tone tuning signal from $EL=\beta\cdot|EG-1|\cdot(\gamma\cdot L-I_i)$, $I_L=I_i^{EL}$, where $\beta$ is a first parameter from the plurality of user configuration parameters that controls a strength of the local tone tuning signal, EG is the final exponent, $\gamma$ is a second parameter from the plurality of user configuration parameters that controls a direction of the local tone tuning signal, L is the final luminance value, $I_i$ is the input display data, $I_L$ is the local tone tuning signal, and EL is an exponent for the local tone tuning signal.

The merger may generate the output display data based on a product of the intermediate display data and the local tone tuning signal.

According to some embodiments of the inventive concept, there is provided a method of controlling a display, including receiving an ambient light signal, a power saving attempt level, and input display data, calculating an intermediate display data $I_G=I_i^{EG}$, wherein $I_i$ is the input display data and exponent EG is calculated from the ambient light signal, the power saving attempt level, and the input display data, dividing the input display data into a plurality of sets of multiple sub blocks, where each set has a different number of sub blocks, and the sub blocks have different sizes, calculating a set of feature values corresponding to each set of multiple sub blocks, wherein a feature value is calculated for each sub block in each set of sub blocks, calculating a luminance value for each set of multiple sub blocks by interpolating values of the set of feature values corresponding to each set of multiple sub blocks, calculating a final luminance value from a weighted sum of the luminance values for each set of multiple sub blocks, calculating a local tone tuning signal $I_L$ from $I_L=I_i^{EL}$, wherein exponent EL is calculated from $EL=\beta|EG-1|(\gamma L-I_i)$, wherein L is the final luminance value and $\beta$ and $\gamma$ are a fourth and a fifth user configuration value, respectively, and calculating an output display signal $I_o$ from the local tone tuning signal $I_L$ and the intermediate display data $I_G$ using $I_o=I_G\cdot I_L=I_i^{EG+EL}$.

The input display data $I_i$ may include multiple components and the intermediate display data $I_G$, local tone tuning signal $I_L$, and output display signal $I_o$ are calculated from one component of the input display data. The method may further include multiplying each other component of the input display data by an enhancement ratio ($I_i/I_o$).

The exponent EG may be calculated from $$EG = (1 - I_i^{\alpha})\frac{\log(T_A)}{\log(P_A)} + I_i^{\alpha}\frac{\log(T_B)}{\log(P_B)},$$

wherein $T_A$ and $T_B$ are a first and a second parameter value, respectively, and $P_A$, $P_B$ and $\alpha$ are a first, a second and a third user configuration value, respectively.

The method may further include calculating the first parameter value based on a statistical analysis of the ambient light signal, the power saving attempt level, and the input display data, wherein the first parameter value controls enhancement of dark tones in the input display data; and calculating the second parameter value based on a statistical analysis of the ambient light signal, the power saving attempt level, and the input display data, wherein the second parameter value controls enhancement of bright tones in the input display data.

DETAILED DESCRIPTION OF EXEMPLARY EMBODIMENTS

Figure 1:
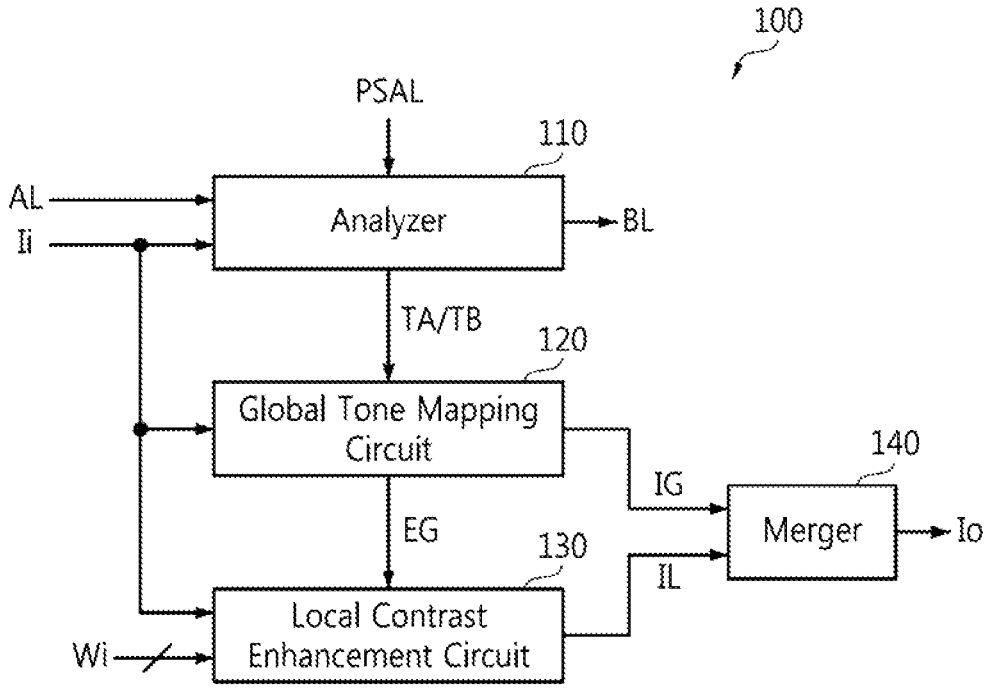
FIG. 1 is a block diagram of a display controller according to some embodiments of the inventive concept.

Exemplary embodiments of the inventive concept will now be described more fully hereinafter with reference to the accompanying drawings, in which embodiments of the disclosure are shown. Embodiments of the disclosure may, however, be embodied in many different forms and should not be construed as limited to the embodiments set forth herein. In the drawings, the size and relative sizes of layers and regions may be exaggerated for clarity. Like numbers may refer to like elements throughout.

It will be understood that when an element is referred to as being "connected" or "coupled" to another element, it can be directly connected or coupled to the other element or intervening elements may be present.

FIG. 1 is a block diagram of a display controller 100 according to some embodiments of the inventive concept. Referring to FIG. 1, the display controller 100 may be embedded in various electronic circuits. The display controller 100 includes an analyzer 110, a global tone mapping circuit 120, a local contrast enhancement circuit 130, and a merger 140.

The display controller 100 receives an ambient light signal AL, a power saving attempt level PSAL, and input display data $I_i$ and generates output display data $I_o$ and a luminance control signal BL.

The ambient light signal AL indicates an ambient light level around a display device or display module driven by the display controller 100. The ambient light signal AL may be generated by an ambient light sensor, which may be implemented as a luminance sensor.

The power saving attempt level PSAL is an attempt level of power saving for the display device. According to embodiments, the power saving attempt level PSAL may be a value set by a user or it may be set using software or a separate configuration circuit according an internal power policy of the display controller 100.

The input display data $I_i$ represents an image to be displayed on the display device. The image may be a two-dimensional (2D) image or three-dimensional (3D) image. The output display data $I_o$ is the final image data to be displayed on the display device with enhanced visibility under a certain ambient light.

In some embodiments, the luminance control signal BL may be used to control a backlight unit for a first display device that includes the backlight unit. For example, the first display device may be a liquid crystal display (LCD) device. In other embodiments, the luminance control signal BL may be used to control the output display data $I_o$ before the output display data $I_o$ is transmitted to a second display device that does not include a backlight unit. For example, the second display device may be an organic light emitting diode (OLED) display device.

The input display data $I_i$ may include multiple components. In some embodiments, the multiple components may include RGB data. In other embodiments, the multiple components may include YCbCr data. In further embodiments, the multiple components may include data for alpha blending and/or data about intensity as well as the RGB data or the YCbCr data.

Since the input display data $I_i$ may includes multiple components, the following methods may be used by the display controller 100.

According to one method, the display controller 100 may process the multiple components independently from one another and may generate multiple components of the output display data $I_o$ and multiple luminance control signals.

For a first display device that includes a backlight unit, the display controller 100 may combine the multiple luminance control signals to generate a final luminance control signal that controls the backlight unit of the first display device.

For a second display device that does not include a backlight unit, the display controller 100 may use the multiple luminance control signals to control the multiple components of the output display data $I_o$ before the multiple components are transmitted to the second display device. In other words, a device that can control multiple components may control the multiple components before transmitting them to a display device. The display device may be a display module or a display panel.

According to another method, the display controller 100 may extract one component, such as an intensity, from the multiple components of the input display data $I_i$, process the extracted component according to some embodiments of the inventive concept, and generate one component of the output display data $I_o$ and one luminance control signal.

Thereafter, the display controller 100 may calculate an enhancement ratio between one component, such as intensity, of the output display data $I_o$ and one component, such as intensity, of the input display data $I_i$, and may apply the enhancement ratio to the multiple components of the input display data $I_i$ to generate the multiple components of the output display data $I_o$.

The analyzer 110 generates two parameter values $T_A$ and $T_B$ for determining global tone mapping of the input display data $I_i$ using the ambient light signal AL, the power saving attempt level PSAL, and the input display data $I_i$; and generates the luminance control signal BL for controlling the display device. Hereinafter, for simplicity of explanation, the input display data $I_i$ may include one component.

The luminance control signal BL may be used to control a backlight unit for the first display device or may be used to control the output display data $I_o$ before the output display data $I_o$ is transmitted to the second display.

Figure 2:
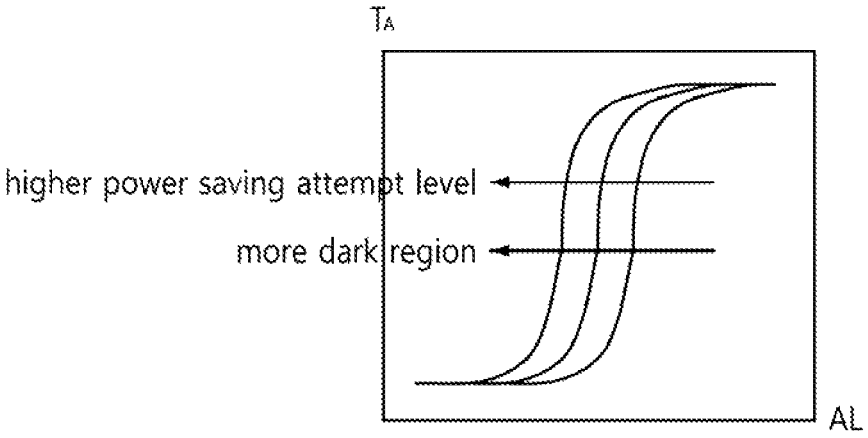
FIG. 2 is a diagram of examples of an S-curve used to determine a first parameter value based on a statistical analysis of an ambient light signal, a power saving attempt level, and input display data.

FIG. 2 is a diagram of examples of an S-curve used to determine the first parameter value $T_A$ based on a statistical analysis of the ambient light signal AL, the power saving attempt level PSAL, and the input display data $I_i$. Referring to FIG. 2, the analyzer 110 may determine the first parameter value $T_A$ based on a statistical analysis, such as a histogram analysis, of the ambient light signal AL, the power saving attempt level PSAL, and the input display data $I_i$. For example, the first parameter value $T_A$ may control enhancement of a dark tone in the input display data $I_i$.

When the ambient light signal AL increases (or decreases), the first parameter value $T_A$ also increases (or decreases).

When the power saving attempt level PSAL increases (or decreases), the first parameter value $T_A$ also increases (or decreases).

When a relatively dark region in the input display data $I_i$ increases, the first parameter value $T_A$ increases.

Figure 3:
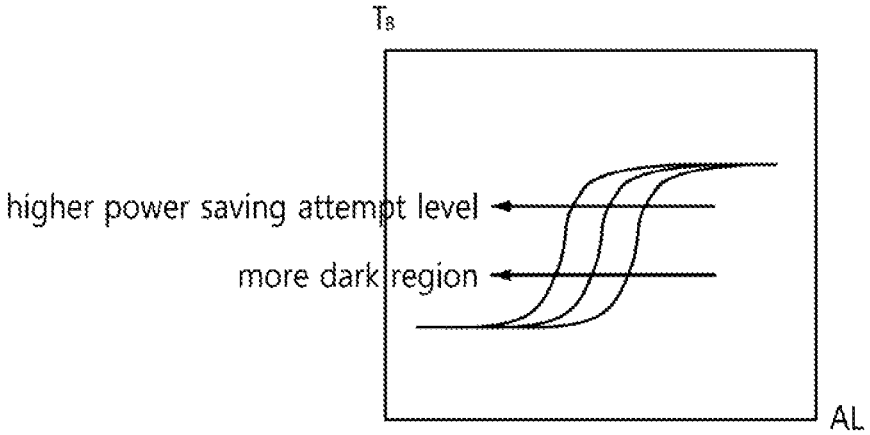
FIG. 3 is a diagram of examples of an S-curve used to determine a second parameter value based on a statistical analysis of an ambient light signal, a power saving attempt level, and input display data.

FIG. 3 is a diagram of examples of an S-curve used to determine the second parameter value $T_B$ based on a statistical analysis of the ambient light signal AL, the power saving attempt level PSAL, and the input display data $I_i$. Referring to FIG. 3, the analyzer 110 may determine the second parameter value $T_B$ based on a statistical analysis, such as a histogram analysis, of the ambient light signal AL, the power saving attempt level PSAL, and the input display data $I_i$. For instance, the second parameter value $T_B$ may control the enhancement of a bright tone in the input display data $I_i$.

The analyzer 110 may determine the second parameter value $T_B$ using a method similar to the method of determining the first parameter value $T_A$. However, the second parameter value $T_B$ has a smaller range than the first parameter value $T_A$ because the human visual system is less sensitive to changes in bright tones than to changes in dark tones.

Figure 4:
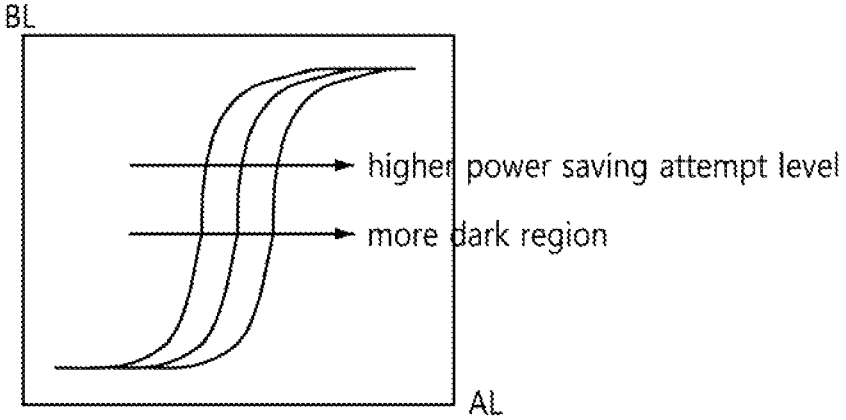
FIG. 4 is a diagram of examples of an S-curve used to determine a luminance control signal based on a statistical analysis of an ambient light signal, a power saving attempt level, and input display data.

FIG. 4 is a diagram of examples of an S-curve used to determine the luminance control signal BL based on a statistical analysis of the ambient light signal AL, the power saving attempt level PSAL, and the input display data $I_i$.

Referring to FIG. 4, the analyzer 110 may determine the luminance control signal BL based on a statistical analysis, such as a histogram analysis, of the ambient light signal AL, the power saving attempt level PSAL, and the input display data $I_i$.

When the ambient light signal AL increases (or decreases), the luminance control signal BL also increases (or decreases).

When the power saving attempt level PSAL increases (or decreases), the luminance control signal BL decreases (or increases).

When a relatively dark region in the input display data $I_i$ increases, the luminance control signal BL decreases.

Figure 5:
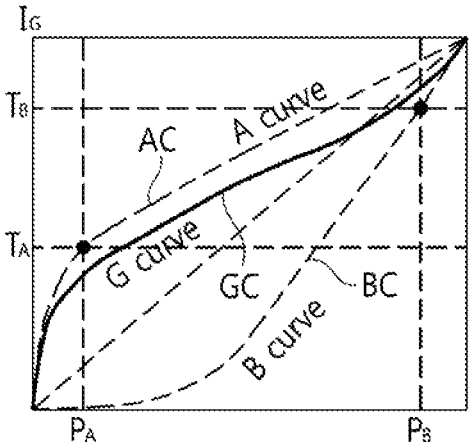
FIG. 5 is a diagram of a global tone mapping curve generated by a global tone mapping circuit illustrated in FIG. 1.

Referring back to FIG. 1, the global tone mapping circuit 120 receives the parameter values $T_A$ and $T_B$ from the analyzer 110 and one component of the input display data $I_i$ and generates intermediate display data $I_G$, which has visibility enhanced from a dark or bright tone and contrast or detail reduced from a mid-tone, using a global tone mapping curve GC illustrated in FIG. 5.

FIG. 5 is a diagram of a global tone mapping curve GC generated by the global tone mapping circuit 120 illustrated in FIG. 1. The global tone mapping G curve GC may be generated or determined based on two parameter values $T_A$ and $T_B$ and three user configuration values $P_A$, $P_B$, and $\alpha$.

A first intermediate A curve AC for global tone mapping may be determined based on the first parameter value $T_A$ and the first user configuration value $P_A$ using Equation 1:

$$EA = \frac{\log(T_A)}{\log(P_A)},\ I_A = I_i^{EA}, \tag{1}$$

where EA denotes an exponent, $I_A$ denotes output data of the first intermediate curve AC, and $I_i$ denotes input display data.

A second intermediate B curve BC for global tone mapping may be determined based on the second parameter value $T_B$ and the second user configuration value $P_B$ using Equation 2:

$$EB = \frac{\log(T_B)}{\log(P_B)},\ I_B = I_i^{EB}, \tag{2}$$

where EB denotes an exponent and $I_B$ denotes output data of the second intermediate curve BC.

The global tone mapping circuit 120 may generate the global tone mapping curve GC for controlling global tone mapping by combining the first intermediate curve AC and the second intermediate curve BC using the third user configuration value "$\alpha$" as shown in Equation 3:

$$EG=(1-I_i^{\alpha})\cdot EA+I_i^{\alpha}\cdot EB,\ I_G=I_i^{EG}, \tag{3}$$

where EG denotes a final exponent and $I_G$ denotes output data of the global tone mapping curve GC, i.e., the intermediate display data.

For example, the first user configuration value $P_A$ may be 0.1; the second user configuration value $P_B$ may be 0.9, and the third user configuration value "$\alpha$" may be 2. The third user configuration value "$\alpha$" may adjust an asymmetric enhancement between dark tone and bright tone. For example, as shown in FIG. 5, the global tone mapping curve GC is closer to the first intermediate curve AC with respect to the dark tone and closer to the second intermediate curve BC with respect to the bright tone.

Figure 6:
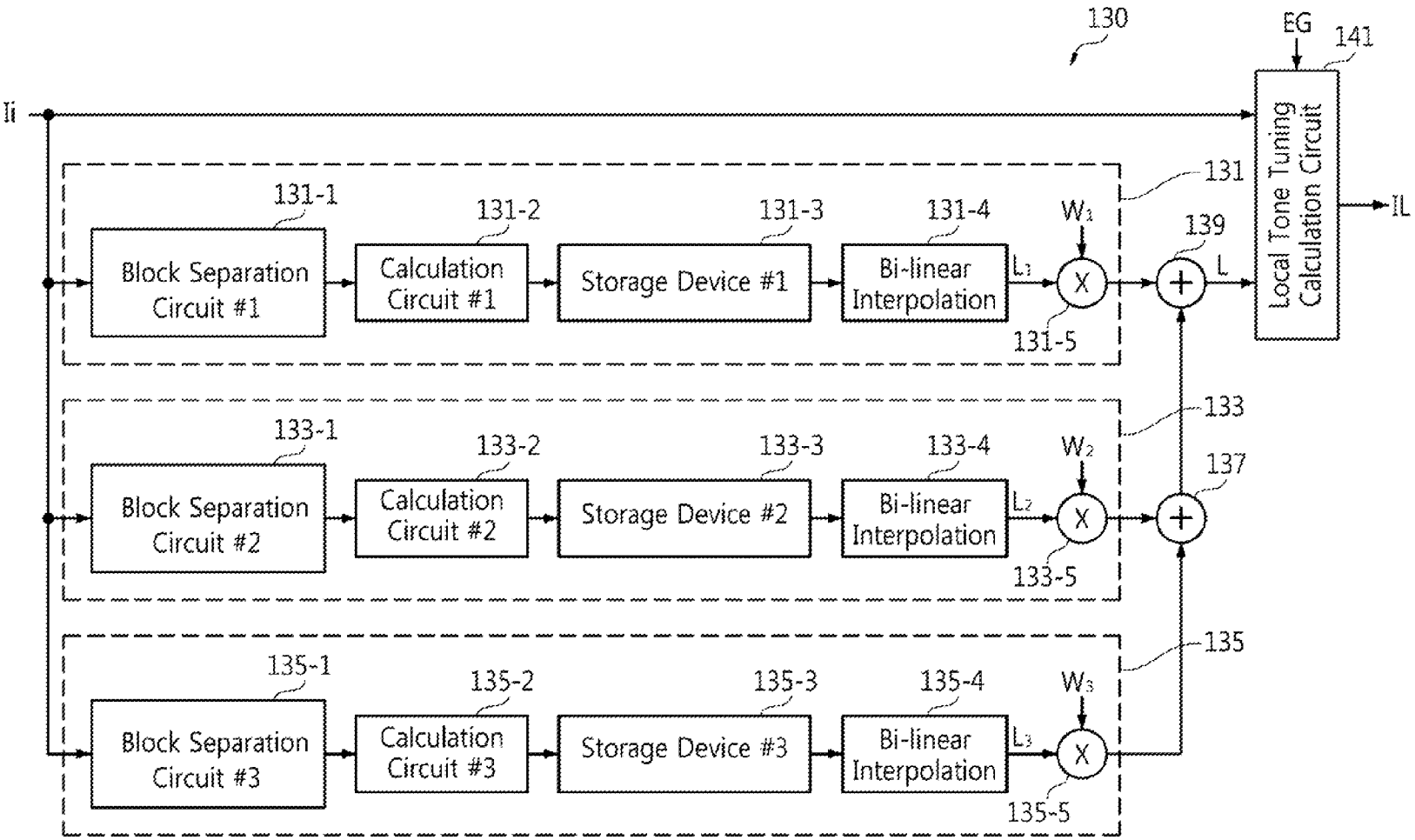
FIG. 6 is a block diagram of a local contrast enhancement circuit illustrated in FIG. 1.

FIG. 6 is a block diagram of the local contrast enhancement circuit 130 illustrated in FIG. 1. The local contrast enhancement circuit 130 may include three scales 131, 133, and 135, however, the number of scales included in the local contrast enhancement circuit 130 may vary with embodiments. For clarity of the description, FIG. 6 shows the local contrast enhancement circuit 130 as including three scales 131, 133, and 135.

The local contrast enhancement circuit 130 receives input display data $I_i$ that represents one component of the input display data $I_i$, weight values $W_i$, and the final exponent coefficient EG for the global tone mapping curve GC, such as the G-curve in FIG. 5; and generates a local tone tuning signal $I_L$.

The local contrast enhancement circuit 130 includes three scales 131, 133, and 135, a first adder 137, a second adder 139, and a local tone tuning calculation circuit 141. Results $L_1$, $L_2$, and $L_3$ of the multiple scales 131, 133, and 135 are respectively combined with weights $W_1$, $W_2$, and $W_3$ by weighted multiplication circuits 131-5, 133-5, and 135-5, accumulated by the first and second adders 137 and 139 to generate intermediate luminance L, which is input to the local tone tuning calculation circuit 141 to generate the local tone tuning signal $I_L$.

The first scale or first scale circuit 131 includes a first block separation circuit 131-1, a first calculation circuit 131-2, a first storage device 131-3, a first interpolation circuit 131-4, and the first weighted multiplication circuit 131-5.

The first block separation circuit 131-1 divides the input display data $I_i$ into first multiple sub blocks. The first calculation circuit 131-2 calculates a feature value that characterizes each of the first multiple sub blocks defined by the first block separation circuit 131-1. The feature value may be an average value, a median value, a minimum value, or a maximum value.

The first storage device 131-3 stores the feature value of each of the first multiple sub blocks for previous display data or previous frame data.

The first interpolation circuit 131-4 interpolates feature values of sub blocks surrounding a pixel that is a target of current processing and calculates a first luminance value $L_1$ for a pixel in the input display data $I_i$, such as current frame data. In some embodiments, while interpolating the feature values of the surrounding sub blocks, the first interpolation circuit 131-4 uses distance information between the current processing target pixel and each of the surrounding sub blocks.

For example, the first interpolation circuit 131-4 may be implemented as a bi-linear interpolation circuit. The bi-linear interpolation circuit may bi-linearly interpolate the feature values, such as average values, of the sub blocks surrounding the target pixel and calculate the first luminance value $L_1$ for the pixel in the input display data $I_i$, such as current frame data.

The first weighted multiplication circuit 131-5 performs an operation, such as multiplying the first luminance value $L_1$ by a first weight value $W_1$ to generate a first weighted luminance value.

The second scale or second scale circuit 133 includes a second block separation circuit 133-1, a second calculation circuit 133-2, a second storage device 133-3, a second interpolation circuit 133-4, and the second weighted multiplication circuit 133-5.

The second block separation circuit 133-1 divides the input display data $I_i$ into second multiple sub blocks. The second calculation circuit 133-2 calculates a feature value, such as an average value, that characterizes each of the second multiple sub blocks defined by the second block separation circuit 133-1.

The second storage device 133-3 stores the feature value, such as the average value, of each of the second multiple sub blocks for previous display data or previous frame data.

The second interpolation circuit 133-4 interpolates feature values, such as average values, of sub blocks surrounding a pixel that is a target of current processing and calculates a second luminance value $L_2$ for the pixel in the input display data $I_i$, such as current frame data. In some embodiments, while interpolating the feature values of the surrounding sub blocks, the second interpolation circuit 133-4 uses distance information between the current processing target pixel and each of the surrounding sub blocks. The second interpolation circuit 133-4 may be implemented as a bi-linear interpolation circuit.

The second weighted multiplication circuit 133-5 performs an operation, such as multiplying the second luminance value $L_2$ by a second weight value $W_2$ to generate a second weighted luminance value.

The third scale or third scale circuit 135 includes a third block separation circuit 135-1, a third calculation circuit 135-2, a third storage device 135-3, a third interpolation circuit 135-4, and the third weighted multiplication circuit 135-5.

The storage devices 131-3, 133-3, and 135-3 may be any type of storage devices that can store data. For example, each of the storage devices 131-3, 133-3, and 135-3 may be implemented as a register, a flip-flop, or a latch.

The third block separation circuit 135-1 divides the input display data $I_i$ into third multiple sub blocks. The third calculation circuit 135-2 calculates a feature value, such as an average value, that characterizes each of the third multiple sub blocks defined by the third block separation circuit 135-1.

The third storage device 135-3 stores the feature value, such as the average value, of each of the third multiple sub blocks for previous display data or previous frame data.

The third interpolation circuit 135-4 interpolates feature values, such as average values, of sub blocks surrounding a pixel that is a target of current processing and calculates a third luminance value $L_3$ for a pixel in the input display data $I_i$, such as the current frame data. In some embodiments, while interpolating the feature values of the surrounding sub blocks, the third interpolation circuit 135-4 uses distance information between the current processing target pixel and each of the surrounding sub blocks. The third interpolation circuit 135-4 may be implemented as a bi-linear interpolation circuit.

The third weighted multiplication circuit 135-5 performs an operation, such as multiplying the third luminance value $L_3$ by a third weight value $W_3$ to generate a third weighted luminance value. Here, the weight values $W_i$ include the first weight value $W_1$, the second weight value $W_2$, and the third weight value $W_3$.

The first adder 137 adds the second weighted luminance value and the third weighted luminance value. The second adder 139 adds an output value of the first adder 137 and the first weighted luminance value to generate a final luminance value L.

The local tone tuning calculation circuit 141 generates the local tone tuning signal $I_L$ using input display data $I_i$ representing one component of the input display data $I_i$, the final luminance value L, and the final exponent coefficient EG for the global tone mapping curve GC, that is, the G-curve in FIG. 5.

The number and/or size of multiple sub blocks may differ among the scales 131, 133, and 135.

Figure 7A:
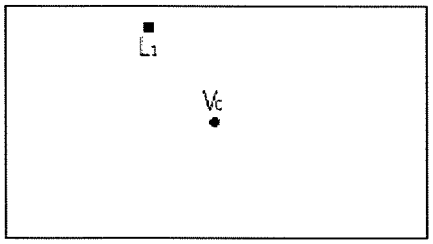
FIGS. 7(*a*) through 7(*c*) are conceptual diagrams that illustrate the operations of a block separation circuit and a bi-linear interpolation circuit in each scale.
Figure 7B:
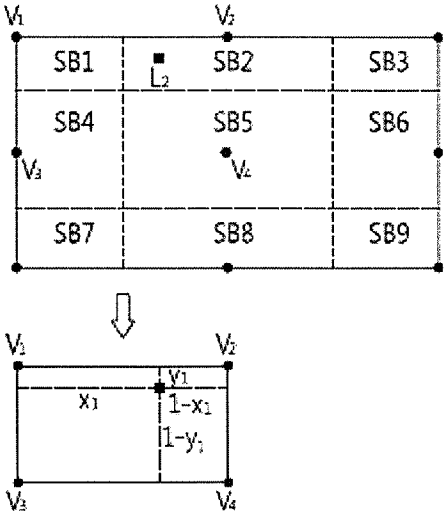
Figure 7C:
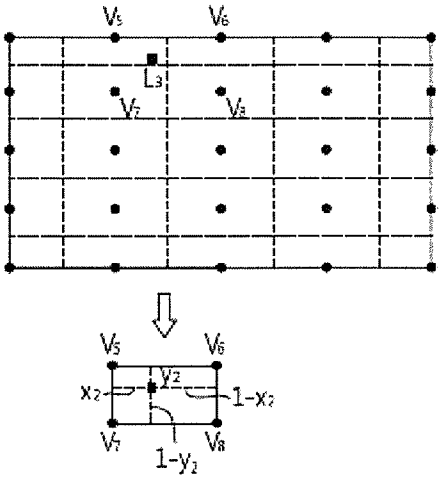

FIGS. 7(*a*) through 7(*c*) are conceptual diagrams that illustrate the operations of the block separation circuits 131-1, 133-1, and 135-1 and the bi-linear interpolation circuits 131-4, 133-4, and 135-4 in the respective scales 131, 133, and 135. The conceptual diagrams illustrated in FIGS. 7(*a*) through 7(*c*) are non-limiting examples for explanation. The number and/or size of multiple sub blocks generated in each of the scales 131, 133, and 135 may vary with embodiments.

Referring to FIG. 6 and FIGS. 7(*a*) through 7(*c*), it may be assumed that the input display data $I_i$ is divided into a 1×1 sub block shown in FIG. 7(*a*) by the first block separation circuit 131-1, the input display data $I_i$ is divided into 3×3 sub blocks shown in FIG. 7(*b*) by the second block separation circuit 133-1, and the input display data $I_i$ is divided into 5×5 sub blocks shown in FIG. 7(*c*) by the third block separation circuit 135-1. Note, however, that the division of the input display data $I_i$ into sub blocks as illustrated with reference to FIGS. 7(*a*)-(*c*) is exemplary and non-limiting, and other schemes of dividing the input display data $I_i$ into sub blocks may be implemented in other embodiments of the inventive concept.

Referring to FIG. 7(*b*), four sub blocks SB1, SB3, SB7, and SB9 at four respective corners of the input display data $I_i$ have a smallest block size. Sub blocks SB4, SB6, SB2, and SB8 along the left, right, top and bottom borders between the corners have a medium block size. A remaining sub block SB5 in the middle of the input display data $I_i$ has a largest block size.

Referring to FIG. 7(*c*), four sub blocks at four respective corners of the input display data $I_i$ have a smallest block size. Twelve sub blocks at left, right, top and bottom borders between the corners have a medium block size. The remaining nine sub blocks in the interior of the input display data $I_i$ have a largest block size.

Each of the calculation circuits 131-2, 133-2, and 135-2 calculates a feature value from all pixels in each sub block. The feature value may be an average value, a median value, a minimum value, or a maximum value. Hereinafter, for simplicity of the description, it may be assumed that the feature value is the average value. However, it is to be understood that other feature values may be substituted for the average values in the following description.

An average value for each of four corner sub blocks may correspond to a value of one of the four corner pixels in the input display data $I_i$. An average value for each of sub blocks along the left, right, top and bottom borders may correspond to a value of a pixel in the middle of each border sub block. An average value for each of the remaining interior sub blocks may correspond to a value of a pixel at the center of each remaining interior sub block.

If each of the interpolation circuits 131-4, 133-4, and 135-4 is implemented as a bi-linear interpolation circuit, each bi-linear interpolation circuit may calculate the luminance value $L_1$, $L_2$, or $L_3$ by bi-linearly interpolating the average values of four sub blocks $V_1$ through $V_8$ that surround one of current pixels using Equation 4:

$$L_1=V_0$$

$$L_2=(1-x_1)\cdot(1-y_1)\cdot V_1+x_1\cdot(1-y_1)\cdot V_2+(1-x_1)\cdot y_1\cdot V_3+x_1\cdot y_1\cdot V_4$$

$$L_3=(1-x_2)\cdot(1-y_2)\cdot V_5+x_2\cdot(1-y_2)\cdot V_6+(1-x_2)\cdot y_2\cdot V_7+x_2\cdot y_2\cdot V_8, \quad (4)$$

wherein the $x_i$ and $y_i$ represents the coordinates of the pixels corresponding to the sub block averages.

The interpolation circuits 131-4, 133-4, and 135-4 may be implemented to perform interpolations other than a bi-linear interpolation. Since only one sub block exists for the embodiment shown in FIG. 7(*a*), the first scale 131 does not perform interpolation.

The final luminance signal L is calculated using a weighted summation of the luminance values $L_1$, $L_2$, and $L_3$ output from the respective scales 131, 133, and 135, that is, the luminance values $L_1$, $L_2$, and $L_3$ may be calculated using Equation 5:

$$L=\Sigma w_i\cdot L_i; \quad (5)$$

as performed by adders 137 and 139, where $W_i$ may be a fixed value or a content-adaptive value.

The local tone tuning calculation circuit 141 may calculate the local tone tuning signal $I_L$ using Equation 6:

$$EL=\beta\cdot|EG-1|\cdot(\gamma\cdot L-I_i),\ I_L=I_i^{EL}, \quad (6)$$

where β is a fourth user configuration value that controls the strength of the local tone tuning signal $I_L$, EG is a final exponent coefficient, γ is a fifth user configuration value that controls the direction of the local tone tuning signal $I_L$, and EL is an exponent for the local tone tuning signal $I_L$. Here, γ may be a fixed value or a content-adaptive value.

Referring back to FIG. 1, the merger 140 receives the intermediate display data $I_G$ from the global tone mapping circuit 120 and the local tone tuning signal $I_L$ from the local contrast enhancement circuit 130 and generates the output display data $I_o$ using Equation 7:

$$I_o=I_G\cdot I_L=I_i^{EG}\cdot I_i^{EL}=I_i^{EG+EL}. \quad (7)$$

When one component, such as an intensity, is extracted from the input display data $I_i$, one component of the output display data $I_o$ is generated by the display controller 100. To obtain all components of the output display data $I_o$, all components of output display data, such as $R_o$, $G_o$, and $B_o$, can be generated using an enhancement ratio $I_o/I_i$ that is applied to input display data, such as $R_i$, $G_i$, and $B_i$, as shown in Equation 8:

$$R_o=R_i\cdot(I_o/I_i)$$

$$G_o=G_i\cdot(I_o/I_i)$$

$$B_o=B_i\cdot(I_o/I_i) \quad (8)$$

Figure 8:
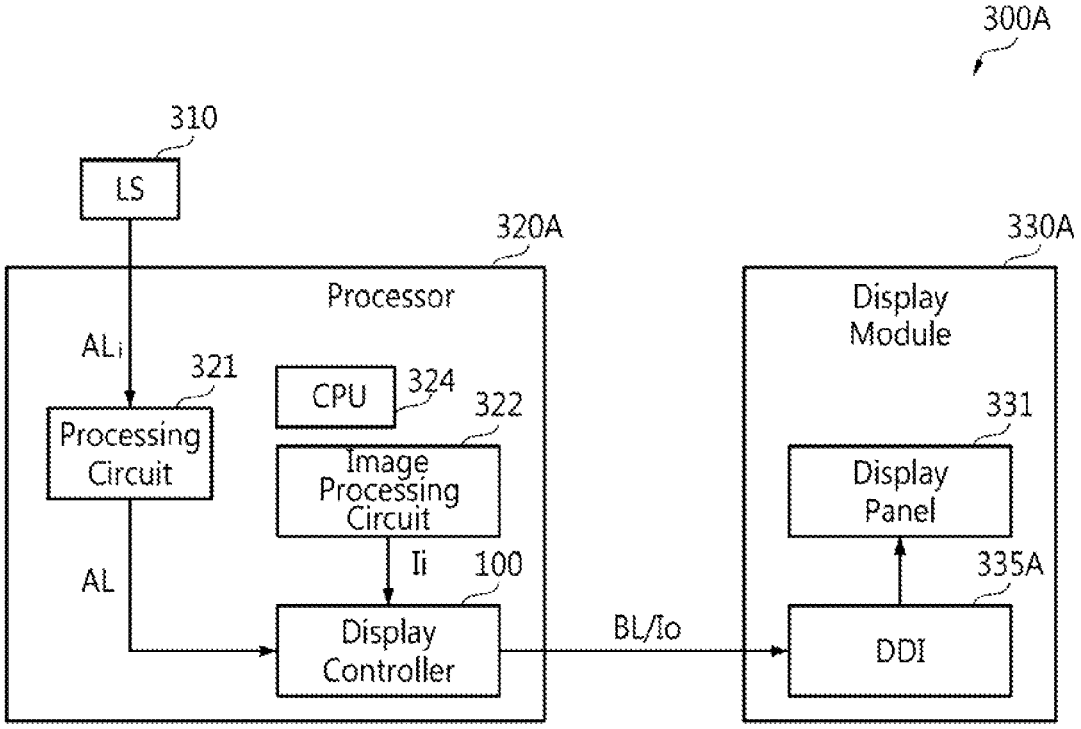
FIG. 8 is a diagram of a display system that includes a display controller illustrated in FIG. 1 according to some embodiments of the inventive concept.

FIG. 8 is a diagram of a display system 300A that includes a display controller 100 illustrated in FIG. 1 according to some embodiments of the inventive concept. Referring to FIGS. 1 through 8, the display system 300A includes a luminance sensor (LS) 310, a processor 320A, and a display module 330A.

The processor 320A and the display module 330A may communicate commands and/or data with each other through an interface. The interface may be an MIPI® display serial interface (DSI), an embedded displayPort (eDP) interface, or a high-definition multimedia interface (HDMI). The luminance control signal BL and the output display data $I_o$ may be transmitted to the display module 330A through one of those interfaces or another interface. The interface may include a plurality of signal transmission lines.

A display systems 300A, 300B, 300C, or 300D illustrated in FIG. 8, 9, 10, or 11 may each be a system that can process display data. Each of the display systems 300A, 300B, 300C, or 300D may be implemented as a television (TV), a digital TV (DTV), an internet protocol TV (IPTV), a personal computer (PC), or a portable electronic device. The portable electronic device may be a laptop computer, a cellular phone, a smart phone, a tablet PC, a personal digital assistant (PDA), an enterprise digital assistant (EDA), a digital still camera, a digital video camera, a portable multimedia player (PMP), a personal navigation device or portable navigation device (PND), a handheld game console, a mobile internet device (MID), a wearable computer, an internet of things (IoT) device, an internet of everything (IoE) device, or an e-book.

The LS 310 senses ambient light of the display system 300A and generates an input ambient light signal $AL_i$.

The processor 320A can control the display module 330A. The processor 320A may be implemented as an integrated circuit (IC), a system on chip (SoC), an application processor (AP), or a mobile AP. The processor 320A may be referred to as a host.

The processor 320A includes a display controller 100, a processing circuit 321, an image processing circuit 322, and a central processing unit (CPU) 324. The display controller 100 may perform functions that have been described with reference to FIGS. 1 through 7C.

The processing circuit 321 may process the input ambient light signal $AL_i$ generated by the LS 310 into the ambient light signal AL that can be processed by the display controller 100. The input ambient light signal $AL_i$ generated by the LS 310 may have a different format than the ambient light signal AL generated by the processing circuit 321.

The image processing circuit 322 may be any one of various types of circuits that can generate input display data $I_i$ processable by the display controller 100. For example, the image processing circuit 322 may be a camera interface, a codec, or a memory interface. The CPU 324 may set the power saving attempt level PSAL and/or the weight values $W_i$. The CPU 324 may control the operations of the elements 321, 322, and 100.

The display module 330A includes a display panel 331 and a display driver IC (DDI) 335A. The display module 330A illustrated in FIG. 8 does not include a backlight unit. The display panel 331 may display the output display data $I_o$. The DDI 335A, which can drive the display panel 331, may control at least one of the multiple components of the output display data $I_o$ in response to the luminance control signal BL.

Figure 9:
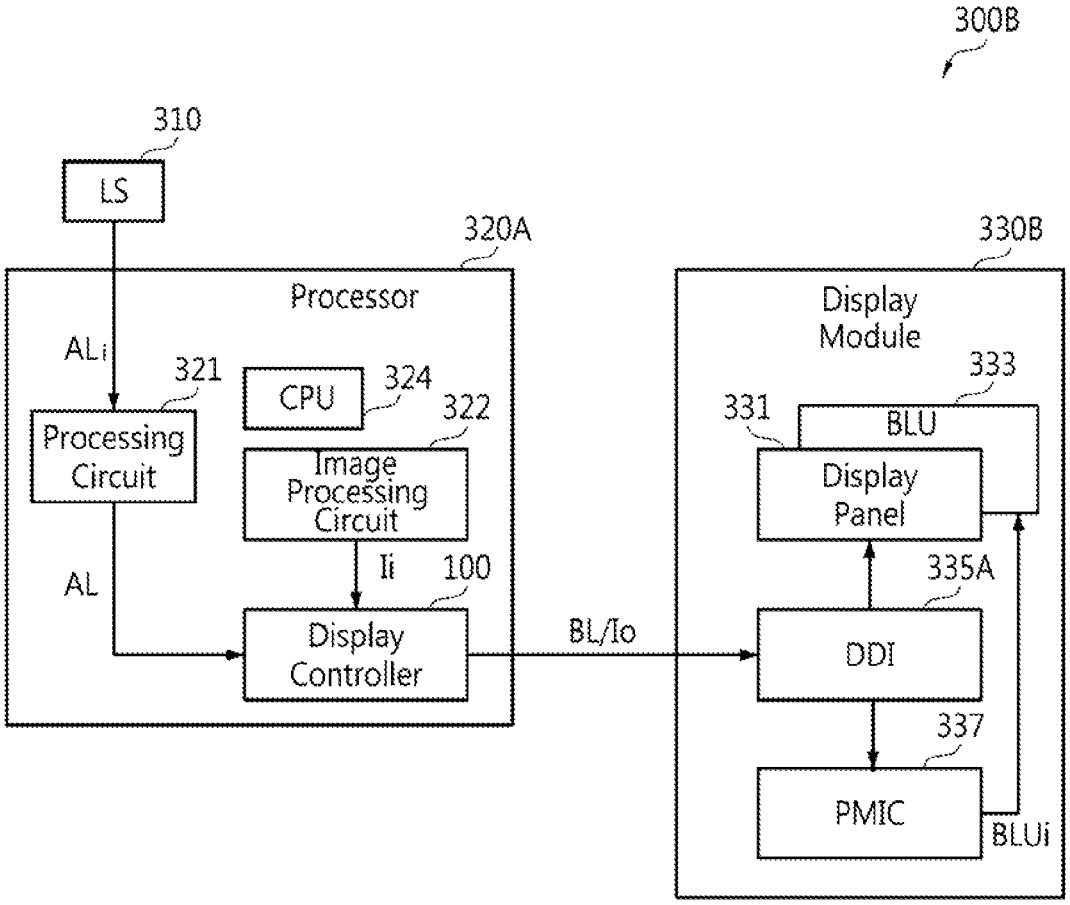
FIG. 9 is a diagram of a display system that includes a display controller illustrated in FIG. 1 according to other embodiments of the inventive concept.

FIG. 9 is a diagram of a display system 300B that includes a display controller 100 illustrated in FIG. 1 according to other embodiments of the inventive concept. Referring to FIGS. 1 through 7C and FIG. 9, the display system 300B includes an LS 310, a processor 320A, and a display module 330B. The processor 320A and the display module 330B may communicate commands and/or data with each other through an interface. The interface may be a DSI, an eDP interface, or an HDMI. The luminance control signal BL and the output display data $I_o$ may be transmitted to the display module 330B through one of those interfaces or another interface.

The LS 310 senses ambient light of the display system 300B and generates the input ambient light signal $AL_i$.

The structure and operations of the processor 320A illustrated in FIG. 9 are substantially the same as or similar to those of the processor 320A illustrated in FIG. 8, and thus a repeated description will be omitted.

The display module 330B includes a display panel 331, a backlight unit (BLU) 333, a DDI 335A, and a power management IC (PMIC) 337. The display panel 331 may display the output display data $I_o$. The BLU 333 may operate in response to a backlight control signal BLUi received from the PMIC 337.

The DDI 335A, which can control the operation of the display panel 331, may control the operation of the PMIC 337 in response to the luminance control signal BL. Accordingly, the PMIC 337 may transmit the backlight control signal BLUi for controlling operation of the BLU 333 to the BLU 333 in response to the luminance control signal BL.

Figure 10:
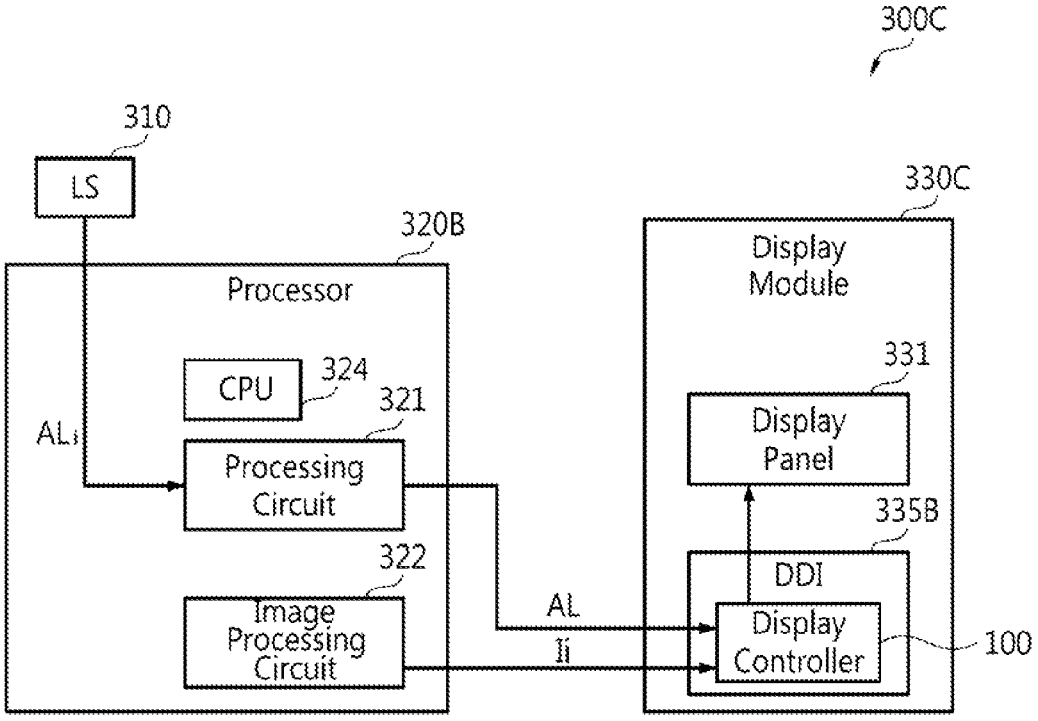
FIG. 10 is a diagram of a display system that includes a display controller illustrated in FIG. 1 according to still other embodiments of the inventive concept.

FIG. 10 is a diagram of a display system 300C that includes a display controller 100 illustrated in FIG. 1 according to still other embodiments of the inventive concept. Referring to FIGS. 1 through 8 and FIG. 10, the display system 300C includes an LS 310, a processor 320B, and a display module 330C. The processor 320B and the display module 330C may communicate commands and/or data with each other through an interface. The interface may be a DSI, an eDP interface, or an HDMI. The input ambient light signal $AL_i$ and the input display data $I_i$ may be transmitted to the display module 330C through one of those interfaces or another interface.

The LS 310 senses ambient light of the display system 300C and generates the input ambient light signal $AL_i$.

The processor 320B can control the display module 330C. The processor 320B may be implemented as an IC, a SoC, an AP, or a mobile AP. The processor 320B includes the processing circuit 321, the image processing circuit 322, and the CPU 324. The processing circuit 321 outputs the ambient light signal AL or a related signal to the display controller 100 included in the display module 330C.

The display module 330C includes the display panel 331 and the DDI 335B. The DDI 335B may include the display controller 100. The display module 330C illustrated in FIG. 10 does not include a BLU.

The image processing circuit 322 can generate the input display data $I_i$. The CPU 324 may set the power saving attempt level PSAL and/or the weight values $W_i$ in a register in a DDI 335B included in the display module 330C.

The DDI 335B can drive the display panel 331. The DDI 335B may control at least one of the multiple components of the output display data $I_o$ output from the display controller 100 in response to the luminance control signal BL output from the display controller 100.

Figure 11:
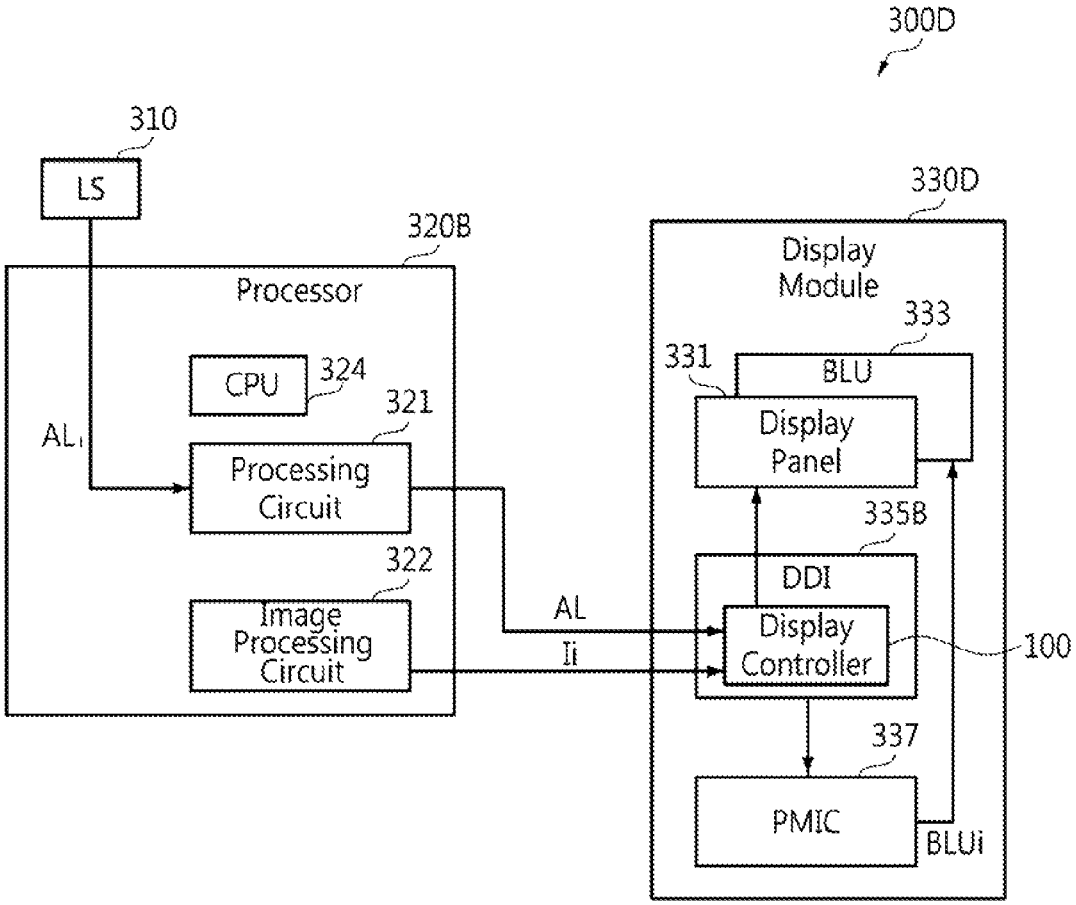
FIG. 11 is a diagram of a display system that includes a display controller illustrated in FIG. 1 according to further embodiments of the inventive concept.

FIG. 11 is a diagram of a display system 300D that includes a display controller 100 illustrated in FIG. 1 according to further embodiments of the inventive concept. Referring to FIGS. 1 through 7C and FIGS. 10 and 11, the display system 300D includes the LS 310, the processor 320B, and a display module 330D. The processor 320B and the display module 330D may communicate commands and/or data with each other through an interface. The interface may be a DSI, an eDP interface, or an HDMI. The input ambient light signal $AL_i$ and the input display data $I_i$ may be transmitted to the display module 330D through one of those interfaces or another interface.

The LS 310 senses ambient light of the display system 300D and generates the input ambient light signal $AL_i$. The structure and operations of the processor 320B illustrated in FIG. 11 are substantially the same as or similar to those of the processor 320B illustrated in FIG. 10, and thus a repeated description will be omitted.

The display module 330D includes the display panel 331, the BLU 333, the DDI 335A, and the PMIC 337. The DDI 335B can drive the display panel 331. The BLU 333 may operate in response to the backlight control signal BLUi received from the PMIC 337.

The DDI 335B may control the operation of the PMIC 337 in response to the luminance control signal BL received from the display controller 100. Accordingly, the PMIC 337 may transmit the backlight control signal BLUi for controlling operation of the BLU 333 to the BLU 333 in response to the luminance control signal BL.

As described above, according to exemplary embodiments of the inventive concept, a display controller can enhance visibility of a display device and reduce its power consumption based on ambient light.

While embodiments of the inventive concept have been particularly shown and described with reference to exemplary embodiments thereof, it will be understood by those of ordinary skill in the art that various changes in forms and details may be made therein without departing from the spirit and scope of the exemplary embodiments of the inventive concept as defined by the following claims.

What is claimed is:

1. A display controller, comprising:

a local contrast enhancement circuit that includes a plurality of scale circuits, wherein each scale circuit comprises:

a block separation circuit configured to divide input display data into sub blocks;

a calculation circuit configured to calculate a feature value that characterizes each of the sub blocks; and a storage device configured to store the feature value, wherein a number and size of each of the sub blocks differ from each other.

2. The display controller of claim 1, wherein the feature value is one of an average value, a median value, a minimum value, and a maximum value.

3. The display controller of claim 1, wherein each of the scale circuits further comprises:

an interpolation circuit connected to the storage device and configured to interpolate feature values of sub blocks that surround a current pixel to generate a luminance value of the current pixel; and a weighted multiplication circuit configured to generate a weighted luminance value using the luminance value of the current pixel and a corresponding weight value, wherein the interpolation circuit uses distance information between the current pixel and each of the surrounding sub blocks while interpolating feature values.

4. The display controller of claim 3, wherein the interpolation circuit generates the luminance value of the current pixel by bi-linearly interpolating the feature values of the sub blocks that surround the current pixel.

5. The display controller of claim 3, wherein the local contrast enhancement circuit further comprises:

an adder circuit configured to sum weighted luminance values generated by the respective scale circuits to generate a final luminance value; and a local tone tuning calculation circuit configured to generate a local tone tuning signal using the input display data, the final exponent, and the final luminance value.

6. The display controller of claim 5, wherein the local tone tuning calculation circuit generates a local tone tuning signal $I_L$ that is a function of β, γ, L, EG, and $I_i$, wherein β is a first user configuration parameter that controls a strength of the local tone tuning signal, γ is a second user configuration parameter that controls a direction of the local tone tuning signal, L is the final luminance value, $I_i$ is the input display data, and EG is an exponent that is a function of a first parameter value, a second parameter value, and a plurality of user configuration values.

7. A display controller comprising:

an analyzer configured to generate a first parameter value, a second parameter value, and a luminance control signal based on an ambient light signal, input display data, and a power saving attempt level;

a global tone mapping circuit configured to generate a final exponent using the input display data, the first parameter value, the second parameter value, and a plurality of user configuration values and to generate intermediate display data using the final exponent and the input display data;

a local contrast enhancement circuit configured to generate a local tone tuning signal using the input display data, a plurality of weight values, and the final exponent; and a merger configured to generate output display data using the intermediate display data and the local tone tuning signal.

8. The display controller of claim 7, wherein when one or more of the ambient light signal, the power saving attempt level, and a dark region in the input display data increases, the analyzer adjusts the first parameter value to control a dark tone in the input display data and adjusts the second parameter value to control a bright tone in the input display data.

9. The display controller of claim 8, wherein the analyzer increases the luminance control signal when the ambient light signal increases and decreases the luminance control signal when the power saving attempt level increases or the dark region in the input display data increases.

10. The display controller of claim 7, wherein the global tone mapping circuit generates a first exponent using the first parameter value and a first configuration value from the plurality of user configuration values and generates first output data using the input display data and the first exponent;

the global tone mapping circuit generates a second exponent coefficient using the second parameter value and a second configuration value from the plurality of user configuration values and generates second output data using the input display data and the second exponent; and the global tone mapping circuit generates the final exponent coefficient using a third configuration value from the plurality of user configuration values, the input display data, the first exponent, and the second exponent and generates the intermediate display data using the input display data and the final exponent.

11. The display controller of claim 10, wherein the first output data $I_A$ is generated from the first parameter value, the first configuration value, and the input display data;

the second output data $I_B$ is generated from the second parameter value, the second configuration value, and the input display data; and the intermediate display data $I_G$ is generated from the first parameter value, the first configuration value, the second parameter value, the second configuration value, the input display data, and the third configuration value.

12. The display controller of claim 7, wherein the local contrast enhancement circuit comprises a plurality of scale circuits, and each of the scale circuits comprises:

a block separation circuit configured to divide input display data into sub blocks;

a calculation circuit configured to calculate a feature value that characterizes each of the sub blocks; and a storage device configured to store the feature value, wherein a number and size of each of the sub blocks differ from each other.

13. The display controller of claim 12, wherein each of the scale circuits further comprises:

an interpolation circuit connected to the storage device to interpolate feature values of sub blocks that surround a current pixel and to generate a luminance value of the current pixel; and a weighted multiplication circuit configured to generate a weighted luminance value using the luminance value of the current pixel and a corresponding weight value, wherein the interpolation circuit uses distance information between the current pixel and each of the surrounding sub blocks while interpolating feature values.

14. The display controller of claim 13, wherein the local contrast enhancement circuit further comprises:

an adder circuit configured to sum weighted luminance values generated by the respective scale circuits to generate a final luminance value; and a local tone tuning calculation circuit configured to generate the local tone tuning signal using the input display data, the final exponent, and the final luminance value.

15. The display controller of claim 14, wherein the local tone tuning calculation circuit generates the local tone tuning signal $I_L$ from a first parameter from the plurality of user configuration parameters that controls a strength of the local tone tuning signal, a second parameter from the plurality of user configuration parameters that controls a direction of the local tone tuning signal, the final luminance value, the input display data, the first parameter value, the first configuration value, the second parameter value, and the second configuration value.

16. The display controller of claim 7, wherein the merger generates the output display data based on a product of the intermediate display data and the local tone tuning signal.

17. A method of controlling a display, the method comprising the steps of:

receiving an ambient light signal, a power saving attempt level, and input display data;

calculating an intermediate display data $I_G$ from the input display data and an exponent calculated from the ambient light signal, the power saving attempt level, and the input display data;

dividing the input display data into a plurality of sets of multiple sub blocks, where each set has a different number of sub blocks, and the sub blocks have different sizes;

calculating a set of feature values corresponding to each set of multiple sub blocks, wherein a feature value is calculated for each sub block in each set of sub blocks;

calculating a luminance value for each set of multiple sub blocks by interpolating values of the set of feature values corresponding to each set of multiple sub blocks;

calculating a final luminance value from a weighted sum of the luminance values for each set of multiple sub blocks;

calculating a local tone tuning signal $I_L$ from a first parameter from the plurality of user configuration parameters that controls a strength of the local tone tuning signal, a second parameter from the plurality of user configuration parameters that controls a direction of the local tone tuning signal, the final luminance value, the input display data, the first parameter value, the first configuration value, the second parameter value, and the second configuration value; and calculating an output display signal $I_o$ from the local tone tuning signal $I_L$ and the intermediate display data $I_G$.

18. The method of claim 17, wherein the input display data $I_i$ includes multiple components and the intermediate display data $I_G$, local tone tuning signal $I_L$, and output display signal $I_o$ are calculated from one component of the input display data, and the method further comprises multiplying each other component of the input display data by an enhancement ratio of the input display data $I_i$ and the output display signal $I_o$.

19. The method of claim 17, wherein the exponent EG is calculated from the the input display data $I_i$, a first and a second parameter value, and are a first, a second and a third user configuration value, respectively.

20. The method of claim 19, further comprising calculating the first parameter value based on a statistical analysis of the ambient light signal, the power saving attempt level, and the input display data, wherein the first parameter value controls enhancement of dark tones in the input display data; and calculating the second parameter value based on a statistical analysis of the ambient light signal, the power saving attempt level, and the input display data, wherein the second parameter value controls enhancement of bright tones in the input display data.

* * * * *